US006150918A

United States Patent [19]

Berger

[11] Patent Number: 6,150,918

[45] **Date of Patent: *Nov. 21, 2000**

[54] DEGAUSSING UNIT COMPRISING ONE OR TWO THERMISTORS

[75] Inventor: Reinhilde P. M. Berger, Hermt, Belgium

[73] Assignee: BC Components Holdings B.V., Eindhoven, Netherlands

[ * ] Notice: Under 35 U.S.C. 154(b), the term of this patent shall be extended for 368 days.

[21] Appl. No.: 08/639,984

[22] Filed: Apr. 26, 1996

[30] Foreign Application Priority Data

May 3, 1995 [EP] European Pat. Off. ..... 95201144

[51] Int. Cl.[7] ..... H01C 7/13

[52] U.S. Cl. ..... 338/22 R; 338/22 SD; 338/327

[58] Field of Search ..... 338/22 R, 22 SD, 338/327, 316

[56] References Cited

U.S. PATENT DOCUMENTS

| | | | |
|---|---|---|---|
| 3,716,407 | 2/1973 | Kahn | 437/201 |
| 3,793,604 | 2/1974 | Duggan et al. | 338/22 R |
| 3,835,434 | 9/1974 | Kahn | 338/22 R |
| 3,975,307 | 8/1976 | Matsuo et al. | 252/520 |
| 4,357,590 | 11/1982 | Belhomme | 338/23 |
| 5,142,265 | 8/1992 | Motoyoshi et al. | 338/22 R |
| 5,210,516 | 5/1993 | Shikama et al. | 338/22 R |
| 5,219,811 | 6/1993 | Enomoto et al. | 501/138 |
| 5,233,326 | 8/1993 | Motoyoshi | 338/22 R |

FOREIGN PATENT DOCUMENTS

| | | | |
|---|---|---|---|
| 0091812 | 10/1983 | European Pat. Off. . | |
| 63-317915 | 12/1988 | Japan . | |
| 4-24901 | 1/1992 | Japan | 338/22 SD |
| 5189724 | 7/1993 | Japan . | |

*Primary Examiner*—Karl D. Easthom
*Attorney, Agent, or Firm*—Frishauf, Holtz, Goodman, Langer & Chick, P.C.

[57] ABSTRACT

Degaussing units in the form of mono and duo-PTCs are disclosed which can be exposed to high inrush currents without the same leading to fracture at the edges of the ceramic thermistors. The electrode layers of the thermistor (s) completely cover the main surfaces and are composed of a material which comprises a silver alloy containing minimally 4 wt. % and maximally 12 wt. % zinc, and which is applied directly on to the thermistor by means of screen printing. In a preferred embodiment, an alloy containing approximately 6 wt. % zinc is used.

10 Claims, 2 Drawing Sheets

DEGAUSSING UNIT COMPRISING ONE OR TWO THERMISTORS

BACKGROUND OF THE INVENTION

1. Field of the Invention

2. Discussion of the Related Art

The invention relates to a degaussing unit comprising a housing which accommodates a disc-shaped thermistor having a positive temperature coefficient of resistance, than thermistor is provided with an electrode layer on two main surfaces and is clamped between two contact springs via the electrode layers. A degaussing unit of this type is commonly referred to as "mono-PTC".

The invention also relates to a degaussing unit comprising a housing which accommodates two disc-shaped thermistors having a positive temperature coefficient of resistance, which are in thermal contact with each other, with the first thermistor having a relatively low resistance and the second thermistor having a relatively high resistance, and the main surfaces of both thermistors being provided with an electrode layer and both thermistors being clamped between two contact springs via said electrode layers. A degaussing unit of this type is commonly referred to as "duo-PTC".

The invention further relates to a cathode ray tube comprising a degaussing coil and a mono-PTC or duo-PTC degaussing unit.

Degaussing units are used, inter alia, in cathode ray tubes, such as color television receivers and color monitors. They serve to demagnetize the shadow mask of the cathode ray tubes the instant said cathode ray tubes are switched on. In this process, an alternating current is sent through a degaussing coil which is connected in series with a thermistor. As said thermistor has a positive coefficient of resistance and is heated by the alternating current, the intensity of the alternating current decreases rapidly. Such a degaussing treatment of the shadow mask leads to a reduction of color deviations in television or monitor images. If necessary, the degaussing unit comprises a second thermistor having a positive temperature coefficient of resistance and a relatively high resistance. Said thermistor is arranged parallel to the first thermistor and to the coil and serves as a heating element for said first thermistor.

Demagnetizing units of the mono-PTC and duo-PTC types are known per se. For example, U.S. Pat. No. 4,357,590 discloses a duo-PTC comprising a high-ohmic thermistor which is arranged in parallel and a low-ohmic transistor which is arranged in series. The main surfaces of the ceramic thermistors are provided with electrode layers which are applied by means of vapor deposition. Said electrode layers are composed of a first layer of a nickel-chromium alloy, a second layer of silver and a third layer of a silver alloy. Since masks must be used to apply the electrode layers by vapor deposition, the extreme edge of the main surfaces of the thermistors is uncovered. The two thermistors are accommodated in a housing (not shown) where they are clamped between two steel contact springs.

The known degaussing unit has drawbacks. For example, it has been found that it cannot withstand the high in-rush currents prescribed in present and future specifications. More in particular, current intensities of 9 A can cause mechanical damage to the known degaussing unit. Visual inspection has revealed that the use of such high current intensities causes pieces of ceramic material to be chipped from the edge of the thermistors and that sparks can be formed at said edge. For these reasons, said known degaussing unit does not comply with the specifications. It has further been found that the same problem also occurs in mono-PTCs to which a vapor-deposited electrode layer is applied in the same manner.

SUMMARY OF THE INVENTION

It is an object of the invention to solve the above-mentioned technical problem. The invention more particularly aims at providing a degaussing unit which can withstand high inrush currents, for example, of 9 A or more. In addition, it should be possible to manufacture said degaussing unit at low cost.

These and other objects of the invention are achieved by a degaussing unit comprising a housing which accommodates a disc-shaped thermistor having a positive temperature coefficient of resistance, said thermistor being provided with an electrode layer on two main surfaces and being clamped between two contact springs via the electrode layers, said degaussing unit in accordance with the invention being characterized in that said electrode layers completely cover the main surfaces and are composed of a material which comprises a silver alloy containing minimally 3 wt. % and maximally 12 wt. % zinc, said material being applied directly on to the thermistor by means of screen printing.

These and other objects of the invention are also achieved by means of a degaussing unit which comprises a housing which accommodates two disc-shaped thermistors having a positive temperature coefficient of resistance, which are in thermal contact, the first thermistor having a relatively low resistance and the second thermistor having a relatively high resistance, both thermistors being provided with an electrode layer on the main surfaces and being clamped between two contact springs via the electrode layers, said degaussing unit in accordance with the invention being characterized in that the electrode layers of the first thermistor completely cover the main surfaces of this thermistor and are composed of a material which comprises a silver alloy containing minimally 3 wt. % and maximally 12 wt. % zinc, said material being applied directly on to the first thermistor by means of screen printing.

The invention is based on the insight that it is essential that the electrode layers extend all over the main surfaces of the "series"-thermistor. Otherwise, when the high inrush currents are passed on, temperature gradients will develop at the boundary between the covered and uncovered parts of the thermistor. This gradient can lead to fracture in the ceramic material, causing parts of the uncovered edge of the series-arranged thermistor to chip off and causing spark-formation on said edge. If the main surfaces of the thermistor are completely covered by the electrode layer this problem does not occur. The measure in accordance with the invention solves this problem for both mono and duo-PTCs. It is noted that the disc-shaped thermistor may have a circular, an oval, a square or a polygonal perimeter.

The applicant has further found that it is not attractive to manufacture electrode layers, which completely cover the main surfaces of the thermistor, by means of vapor deposition or sputtering. The known application techniques use masks whose surface area must be smaller than that of the main surfaces of the ceramic bodies to be covered. This is necessary to preclude that also the side faces of the disc-shaped ceramic bodies are covered with vapor-deposited material. If the electrode layers are screen printed directly on to the ceramic material, the entire surface can be covered without any problem. There is no risk of the side faces of the ceramic material becoming covered. Screen printing has the additional advantage that single electrode layers are applied. They are applied in a single step. The known electrode layers are provided in several vapor-deposition steps, which makes the known degaussing units extra expensive.

The applicant has also found that by no means all conductive screen-printing pastes are suitable. Only screen-printing pastes containing, in addition to a binder and glass, a certain quantity of zinc proved to be suitable. Said screen-printing pastes meet the three required criteria: (1) the electrode layers manufactured by means of said screen-printing pastes form a resistive contact on the ceramic material, (2) there is no interface resistance layer between the electrode layer and the ceramic material, and (3) the sheet resistance of these electrode layers is very low. It has been found that the silver/zinc-based screen-printing pastes which meet these criteria are unsolderable.

If the silver alloy contains less than 3 wt. % zinc, then the contact resistance between the electrode layer and the ceramic material becomes relatively high. No resistive contact is formed. This is considered to be an important disadvantage. If the silver paste contains more than 12 wt. % zinc, the sheet resistance of the contact layer becomes relatively high. This too is considered to be an important disadvantage. The best results are obtained if the silver alloy contains approximately 6 wt. % zinc. Under these conditions, an optimum combination of a low contact resistance and a low sheet resistance are achieved.

A preferred embodiment of the inventive degaussing unit comprising two thermistors is characterized in that the electrode layers of the second thermistor completely cover the main surfaces of this thermistor and are composed of a material which comprises a silver alloy containing minimally 3 wt. % and maximally 12 wt. % zinc, said material being applied directly on to the second thermistor by means of screen printing. Experiments have shown that such a degaussing unit meets the international standard IEC 801-5 DR AFT regarding electromagnetic compatibility. Requirements to be met by electronic equipment are incorporated in this standard. Said requirements relate, inter alia, to coping with direct-current peaks of 2 kV, which may be caused by a thunderbolt. Such a voltage pulse of 2 kV is superposed on the mains voltage of the degaussing unit.

The invention also relates to a cathode ray tube comprising a degaussing coil and a degaussing unit. In accordance with the invention, a degaussing unit as described hereinabove is used in said cathode ray tube.

These and other aspects of the invention will be apparent from and elucidated with reference to the embodiments described hereinafter.

It is noted that the parts shown in the Figures are not drawn to scale.

DETAILED DESCRIPTION OF THE PREFERRED EMBODIMENTS

Figure 1A:
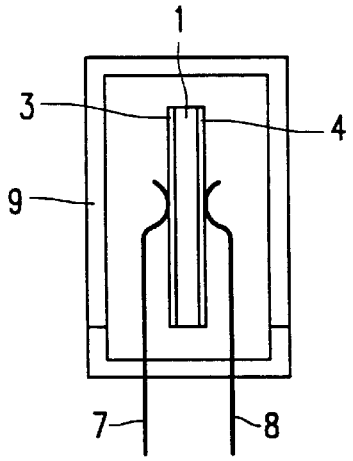
FIGS. 1A and 1B show a mono-PTC and a duo-PTC in accordance with the invention.
Figure 1B:
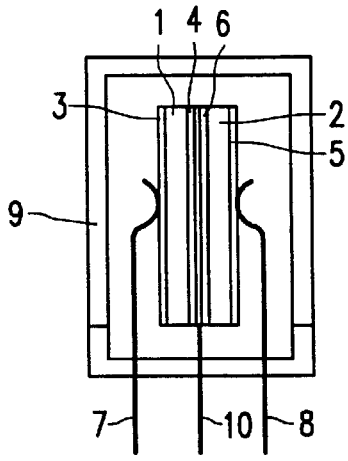

FIG. 1A shows a mono-PTC, and FIG. 1B shows a duo-PTC in accordance with the invention. They comprise a disc-shaped "series"-thermistor 1 having a positive temperature coefficient of resistance. The duo-PTC comprises also a second disc-shaped "parallel"-thermistor 2 having a positive temperature coefficient of resistance. Said circular thermistors are approximately 3 mm thick and approximately 12 mm across. Both thermistors are made from a barium-titanate type of ceramic material, which is doped, inter alia, with Pb and/or Sr. In the present case, the composition of thermistor 1 corresponds to the formula $Ba_{0.85}Sr_{0.115}Pb_{0.035}Ti_{1.01}O_3$, and the composition of thermistor 2 corresponds to the formula $Ba_{0.73}Sr_{0.04}Pb_{0.23}Ti_{1.01}O_3$. Thermistor 1 has a resistance value of approximately 20 Ohm (25° C.) and thermistor 2 has a resistance value of approximately 3000 Ohm (25° C.).

Thermistor 1 is provided on both main surfaces with single electrode layers 3 and 4, which completely cover said main surfaces. Thermistor 2 is also provided on both main surfaces with electrode layers 5 and 6, which preferably completely cover said main surfaces. The thickness of the electrode layers is approximately 10 micrometers. The electrode layers are composed of a material which comprises a silver alloy containing minimally 3 wt. % and maximally 12 wt. % zinc. The alloy preferably comprises approximately 6 wt. % zinc. As will be described in more detail hereinbelow, these electrode layers are provided by means of screen printing in a single operation.

It is noted that duo-PTCs, whose "parallel"-PTC is provided with a different type of electrode layers 5 and 6, for example sputtered or vapour-deposited layers, also have the intended advantage of the invention. In this type of duo-PTCs, the ceramic material of the "series"-thermistor is not damaged when high current intensities are used. Preferably, however, also the electrode layers of the "parallel"-PTC are made of the above-mentioned screen-printed material. This type of PTCs has the additional advantage that it complies with the above-mentioned standard.

The thermistors are clamped between contact springs 7 and 8 of NiCr plated steel in an electrically insulating synthetic resin housing 9, preferably of polyethylene terephtalate. In addition to the contact springs 7 and 8, said duo-PTC comprises a third electrical connection 10. The circuit diagram of the duo-PTC comprising the degaussing coil, during use in a cathode ray tube, is described in greater detail in the above-mentioned prior art. The mono-PTC is arranged in series with said coil.

The electrode layers were provided on the thermistors in the following manner. Sintered, pellet-shaped thermistors being 12 mm across and 3 mm thick were used as the starting materials. The main surfaces of these thermistors were provided with a resistive, zinc-containing silver paste (Demetron) by means of screen printing. Said paste completely covered the main surface. The paste mainly comprises silver, a small quantity of zinc, glass frit and a binder. Subsequently, the binder is fired at approximately 600° C. for 10 minutes. The final electrode layer was formed by this treatment. This electrode layer forms a resistive contact with the ceramic material and exhibits a relatively low sheet resistance. It appeared that the formed electrode layer is very stabile in life-tests relating to storage in damp heat (IEC 68-2-56), storage in dry heat (IEC 68-2-2), cycling in humidity (IEC 68-2-30) and dissipation at maximum rated voltage (CECC 44000).

Within the scope of the experiments which have led to a greater insight into the invention, the following types of degaussing units have been manufactured:

- mono-PTCs with vapor-deposited electrode layers on the thermistor in accordance with the above-mentioned state of the art (type 1).

mono-PTCs with screen-printed electrode layers on the thermistor in accordance with the invention (type 2).

duo-PTCs of which both thermistors were provided with vapour-deposited electrode layers in accordance with the above-mentioned state of the art (type 3).

duo-PTCs of which the "series"-thermistor was provided with a screen-printed electrode layer in accordance with the invention, and the "parallel"-thermistor was provided with a known, vapour-deposited electrode layer (type 4).

duo-PTCs of which both thermistors were provided with screen-printed electrode layers in accordance with the invention (type 5).

In a first series of experiments, a number of degaussing units of type 2 was manufactured, with screen-printed electrode layers being provided which completely covered the main surfaces of the thermistor. The zinc-content of the silver alloy was varied. Said zinc-contents were: 0 wt. % (type 2-*a*), 3 wt. % (type 2-*b*), 6 wt. % (type 2-*c*), 12 wt. % (type 2-*d*) and 15 wt. % (type 2-*e*).

Measurements on these mono-PTCs showed that alloys of the types 2-*b*, 2-*c* and 2-*d* yielded good results, the results of 2-*c* being the best. Relative to 2-*c*, type 2-*b*had the disadvantage that the contact resistance was relatively high. Relative to 2-*c*, type 2-*d* had the drawback that the sheet resistance was relatively high. Types 2-*a* and 2-*e* were found to be sub-standard. The contact resistance of type 2-*a* was unacceptable, and the sheet resistance of type 2-*e* was unacceptably high.

Comparative experiments between degaussing units of type 1 and 2 were carried out. Two series of 100 specimen of either type were exposed to a test using 100 subsequewnt cycles with inrush current of 10 A for 1 minute and a cooling period of 9 minutes. Subsequent visual inspection afterwards revealed that a number of the units of type 1 had been damaged by this experiment. In the case of the damaged specimen, pieces of ceramic material were chipped from the edges of the thermistor or spark-formation had occured at the edges. This type of damage was not found in any of the specimen of the degaussing units of type 2.

In further comparative experiments between degaussing units of type 3 on the one hand and degaussing units of types 4 and 5 on the other hand, the same phenomenon was observed. A considerable number of the "series"-thermistors of type 3 were found to be damaged after experiments in which they were exposed to relatively high inrush currents of 10 A. All "series"-thermistors of the types 4 and 5 were undamaged after this experiment.

Further comparative experiments between types 4 and 5 showed that the degaussing units of type 5 have an interesting advantage over those of type 4. Of either type, a series of 100 specimen was exposed to the so-called "Haefely" test. In said test, these specimen were exposed under normal conditions to a nominal voltage (220–230 V; 50 Hz), alternately 10 negative and 10 positive pulses (1.2/50 microseconds) of 2 kV or more being superposed at a frequency of 6 pulses per minute.

Figure 2:
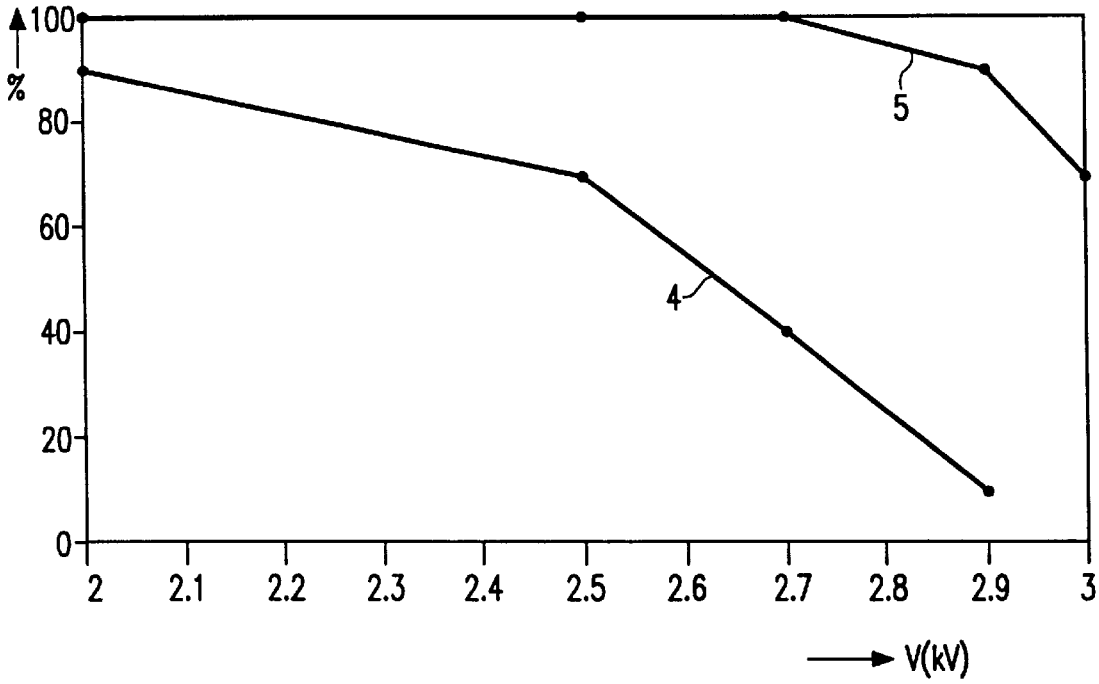
FIG. 2 shows a graph in which the number of rejects is plotted as a function of a pulse voltage for a series of duo-PTCs in accordance with the invention and a series of duo-PTCs not in accordance with the invention.

The results of this test are shown in FIG. 2. Said Figure shows the percentage of satisfactory specimen of types 4 and 5 as a function of said pulse voltage. This Figure shows that all specimen of the degaussing units of type 5 pass this test without problems up to 2.7 kV. In the case of the degaussing units of type 4, however, rejects (10%) already occur when said degaussing units are exposed to a pulse voltage of 2.0 kV.

Several tests moreover demonstrated that no silver migration occurs in the thermistors according to the present invention.

Figure 3A:
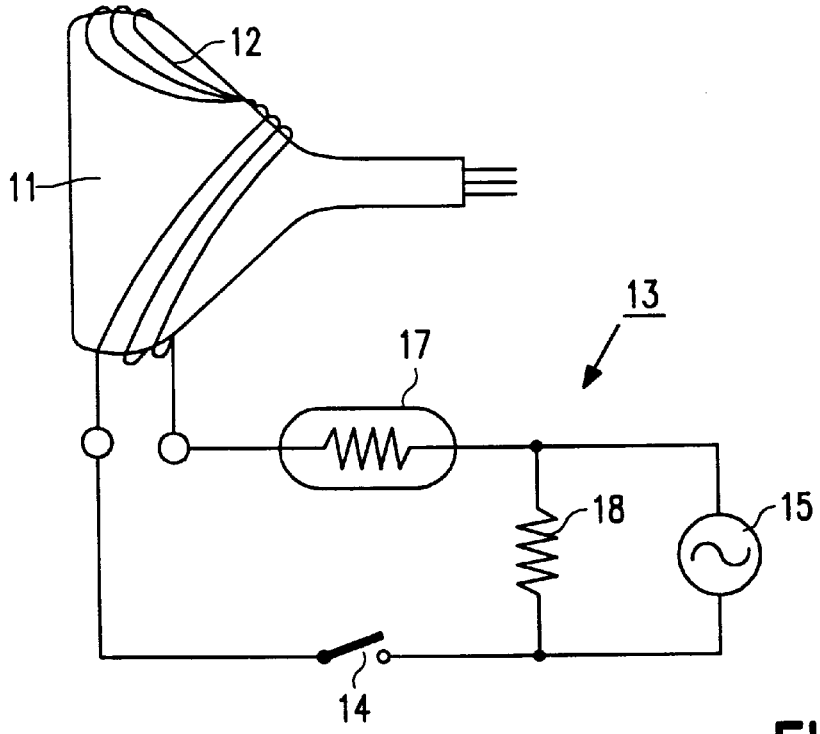
FIGS. 3A and 3B schematically show two cathode ray tubes comprising a degaussing coil and a degaussing unit.
Figure 3B:
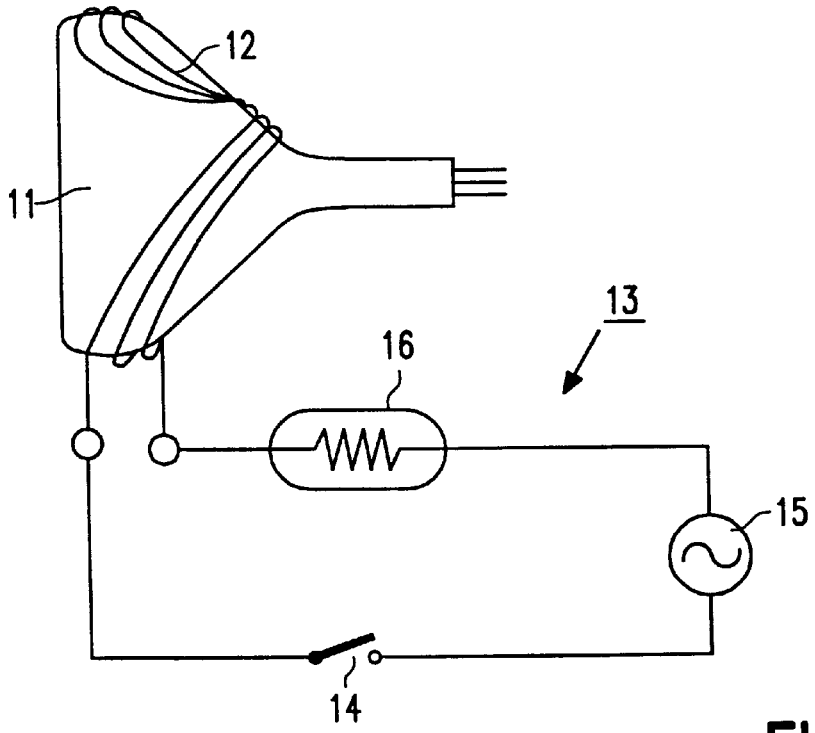

FIGS. 3A and 3B schematically show a cathode ray tube 11 which comprises a degaussing coil 12. Said coil 12 is electrically connected to a degaussing unit 13, switch 14 and an AC voltage source 15. Said degaussing unit comprises a mono-PTC having a single thermistor 16 (FIG. 3B), or a duo-PTC having a first thermistor 17 ("series"-thermistor) and a second thermistor 18 ("parallel"-thermistor; FIG. 3A). After switching on the cathode ray tube by means of a switch 14, a high alternating current is sent through coil 12. Warming-up of the "series"-thermistor causes the current intensity to decrease substantially with time. The magnetic field generated by the alternating current demagnetizes the metal parts in the cathode ray tube, such as, inter alia, the shadow mask.

The invention provides degaussing units in the form of mono and duo-PTCs, which can be exposed to high in-rush currents without this leading to fracture at the edges of the ceramic thermistors. This effect is attained if the electrode layers of the thermistor(s) completely cover the main surfaces and are composed of a material which comprises a silver alloy containing minimally 4 wt. % and maximally 12 wt. % zinc, and which is directly applied to the thermistor by means of screen printing. Optimum results are achieved with an alloy containing approximately 6 wt. % zinc. The application of this type of electrode layers on to the "series"-thermistor and the "parallel"-thermistor of a duo-PTC has the additional advantage that the degaussing unit thus obtained complies with the international standard IEC 801-5 DRAFT.

What is claimed is:

1. A degaussing unit comprising:

a housing; and a disc-shaped thermistor having a positive temperature coefficient of resistance accommodated within said housing, said thermistor including an electrode layer on each of two main surfaces thereof and being clamped between two contact springs via the electrode layers, wherein the electrode layers completely cover the main surfaces and are composed of a material which comprises a silver alloy containing minimally 3 wt. % and maximally 12 wt. % zinc, the material having been applied directly on to the two main surfaces of said thermistor by means of screen printing.

2. A degaussing unit comprising:

a housing; and two disc-shaped thermistors each accommodated within said housing and having a positive temperature coefficient of resistance, which are further in thermal contact with each other, a first of said two disc-shaped thermistors having a relatively low resistance and a second of said two disc-shaped thermistors having a relatively high resistance, each of said two disc-shaped thermistors including an electrode layer on each of two main surfaces thereof, said two disc-shaped thermistors being clamped between two contact springs via outermost electrode layers, wherein the electrode layers of said first thermistor completely cover the two main surfaces of said first thermistor, and are composed of a material which comprises a silver alloy containing minimally 3 wt. % and maximally 12 wt. % zinc, the material having been applied directly on to the two main surfaces of said first thermistor by means of screen printing.

3. The degaussing unit as claimed in claim 2, wherein the electrode layers of said second thermistor completely cover the two main surfaces of said second thermistor and are composed of a material which comprises a silver alloy containing minimally 3 wt. % and maximally 12 wt. % zinc, the material having been applied directly on to the main surfaces of said second thermistor by means of screen printing.

4. The degaussing unit as claimed in claim 1, wherein the silver alloy contains approximately 6 wt. % zinc.

5. A cathode ray tube comprising a degaussing coil and a degaussing unit, said degaussing unit comprising:

a housing; and a disc-shaped thermistor having a positive temperature coefficient of resistance accommodated within said housing, said thermistor including an electrode layer on each of two main surfaces thereof and being clamped between two contact springs via the electrode layers, wherein the electrode layers completely cover the main surfaces and are composed of a material which comprises a silver alloy containing minimally 3 wt. % and maximally 12 wt. % zinc, the material having been applied directly on to the two main surfaces of said thermistor by means of screen printing.

6. The degaussing unit as claimed in claim 2, wherein the silver alloy contains approximately 6 wt. % zinc.

7. The degaussing unit as claimed in claim 3, wherein the silver alloy contains approximately 6 wt. % zinc.

8. A cathode ray tube comprising a degaussing coil and a degaussing unit, said degaussing unit comprising:

a housing: and two disc-shaped thermistors each accommodated within said housing and having a positive temperature coefficient of resistance, which are further in thermal contact with each other, a first of said two disc-shaped thermistors having a relatively low resistance and a second of said two disc-shaped thermistors having a relatively high resistance, each of said two disc-shaped thermistors including an electrode layer on each of two main surfaces thereof, said two disc-shaped thermistors being clamped between two contact springs via outermost electrode layers, wherein the electrode layers of said first thermistor completely cover the two main surfaces of said first thermistor, and are composed of a material which comprises a silver alloy containing minimally 3 wt. % and maximally 12 wt. % zinc, the material having been applied directly on to the two main surfaces of said first thermistor by means of screen printing.

9. A cathode ray tube as claimed in claim 8, wherein the electrode layers of said second thermistor completely cover the two main surfaces of said second thermistor and are composed of a material which comprises a silver alloy containing minimally 3 wt. % and maximally 12 wt. % zinc, the material having been applied directly on to the main surfaces of said second thermistor by means of screen printing.

10. A cathode ray tube as claimed in claim 5, wherein the silver alloy contains approximately 6 wt. % zinc.

* * * * *